US007097674B2

(12) United States Patent
Delfort et al.

(10) Patent No.: US 7,097,674 B2
(45) Date of Patent: Aug. 29, 2006

(54) DIESEL FUEL COMPOSITIONS THAT CONTAIN GLYCEROL ACETAL CARBONATES

(75) Inventors: Bruno Delfort, Paris (FR); Isabelle Durand, Rueil Malmaison (FR); Anne Jaecker, Rueil Malmaison (FR); Thierry Lacome, Condecourt (FR); Xavier Montagne, Rueil Malmaison (FR); Fabrice Paille, Limay (FR)

(73) Assignee: Institut du Petrole, Rueil-Malmaison Cedex (FR)

( * ) Notice: Subject to any disclaimer, the term of this patent is extended or adjusted under 35 U.S.C. 154(b) by 468 days.

(21) Appl. No.: 10/322,473

(22) Filed: Dec. 19, 2002

(65) Prior Publication Data

US 2004/0025417 A1 Feb. 12, 2004

(30) Foreign Application Priority Data

Dec. 19, 2001 (FR) ..... 01 16448

(51) Int. Cl.
*C10L 1/18* (2006.01)
*C10L 1/24* (2006.01)

(52) U.S. Cl. ..... 44/349; 44/300; 44/350; 44/387; 44/388

(58) Field of Classification Search ..... 44/300, 44/349, 385, 387–389, 403, 404, 628, 350
See application file for complete search history.

(56) References Cited

U.S. PATENT DOCUMENTS

| | | | | |
|---|---|---|---|---|
| 3,036,904 A | | 5/1962 | Arkett et al. | |
| 3,755,171 A | * | 8/1973 | Cyba et al. | 508/225 |
| 4,891,049 A | | 1/1990 | Dillon et al. | |
| 4,904,279 A | | 2/1990 | Kanne et al. | |
| 5,182,913 A | * | 2/1993 | Robar et al. | 60/671 |
| 5,268,007 A | | 12/1993 | Walsh | |
| 5,575,944 A | * | 11/1996 | Sawada et al. | 252/68 |
| 5,976,283 A | * | 11/1999 | White et al. | 149/7 |
| 6,172,031 B1 | * | 1/2001 | Stevens | 510/417 |

FOREIGN PATENT DOCUMENTS

GB 1196610 * 7/1970

* cited by examiner

*Primary Examiner*—Vasu Jagannathan
*Assistant Examiner*—Sandra K. Poulos
(74) *Attorney, Agent, or Firm*—Millen, White, Zelano & Branigan, P.C.

(57) ABSTRACT

A diese fuel composition containing a major proportion of at least one diesel fuel and a minor proportion of at least one glycerol acetal carbonate of the formulae:

(1)

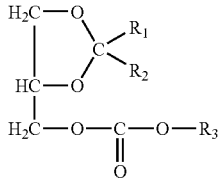

and/or (2)

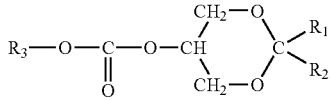

in which:

R1 and R2 each represent a hydrogen atom, a hydrocarbon radical with 1 to 20 carbon atoms that is aliphatic, cycloaliphatic or aromatic, an alkyl-ether chain, whereby R1 and R2 together can form an oxygenated heterocyclic radical;

R3 is a radical that is defined as R1 or R2, except for the hydrogen atom, or a radical of the formula:

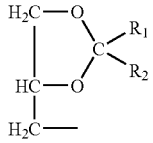

and/or

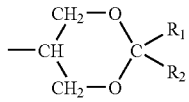

where R1 and R2 are defined as above.

8 Claims, No Drawings

DIESEL FUEL COMPOSITIONS THAT CONTAIN GLYCEROL ACETAL CARBONATES

The invention relates to diesel fuel compositions that contain oxygenated compounds that consist of glycerol acetal carbonates.

Today, improvement in air quality is an absolute priority of all the large industrialized countries. Among the referenced emitters of pollution, transport occupies a place that requires that major measures be taken to reduce their contributions. Thus, a number of formal measures have been issued over the last several years, with new constraints since 2000, in particular specifications on the quality of fuels. Actually, in addition to the conventionally specified characteristics, new regulations on the chemical composition of fuels have been issued for the purpose of limiting the precursors of certain pollutants, such as particles, compounds that are reactive relative to the tropospheric ozone or toxic compounds. In this context, it is obvious that all approaches that aim at improving the quality of products for proposing mixtures that significantly reduce the polluting releases are promising.

One of the objects of the invention is to propose the use of glycerol acetal carbonates as additives or as bases for formulating gas oils that lead to significant reductions in the emissions of particles.

The invention therefore provides diesel fuel compositions that comprise a major proportion of at least one diesel fuel and a minor proportion of at least one glycerol acetal carbonate that corresponds to one of the general formulas:

(1)

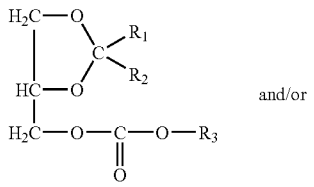

and/or (2)

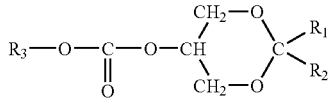

in which:

R1 and R2 each represent a hydrogen atom, a hydrocarbon radical with 1 to 20 carbon atoms that is aliphatic, linear or branched and may or may not be saturated, cycloaliphatic or aromatic, or an alkyl-ether chain, whereby R1 and R2 together can form an oxygenated heterocyclic radical (for example furanic or tetrahydrofuranic);

R3 is a radical that is defined as R1 or R2 except for the hydrogen atom, or a radical of general formula:

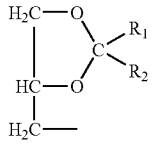

and/or

-continued

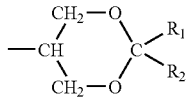

where R1 and R2 are defined as above.

Most often, R1 and R2 are each a hydrogen atom, a methyl, ethyl, or propyl radical, and R3 is a methyl or ethyl radical. The sum of the number of carbon atoms of R1, R2, and R3 is preferably at least 2.

The products that are considered in the invention are generally obtained from glycerol acetals with the general structure:

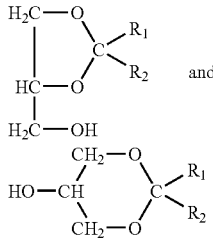

and/or

Starting from these products, a carbonate function is introduced, for example, by transcarbonation reaction according to the diagram:

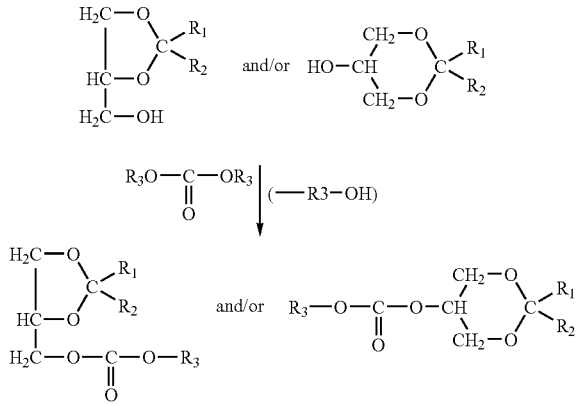

where R1, R2 and R3 are defined as above, whereby R3 is most often a methyl or ethyl radical.

This reaction is generally carried out in a basic medium with a catalyst that is selected, for example, from among hydroxides, carbonates, alkoxides and hydrides of alkaline metals or alkaline-earth metals or other metals.

This reaction can also be carried out by condensation of a urethane of general formula R3-CO—NH2 on the free hydroxyl function of glycerol acetals with release of ammonia, whereby the urethane R3-CO—NH2 can itself be obtained easily by condensation of the alcohol R3-OH with urea.

Other reactions can be considered to introduce a carbonate function. They are listed in an article that reviews them by taking dimethyl carbonate as an example: "Review of Dimethyl Carbonate Manufacture and its Characteristics as a Fuel Additive" appeared in Energy & Fuels, Vol. 11, pp. 2–29 (1997).

The glycerol acetals are themselves most often prepared by reaction, generally in an acid medium of an aldehyde or a ketone on glycerol or by trans-acetylation reaction. These reactions, applied to an alcohol R—OH, are represented by the diagrams below:

$$2R—OH+R'CHO \rightarrow (RO)2CH—R'+H_2O \quad (3)$$

$$2R—OH+(R''O)2CH—R' \rightarrow (RO)2CH—R'+2R''OH \quad (4)$$

Applied to glycerol, the reactions of acetylation or trans-acetylation are multiple. Some can be written according to the following diagrams:

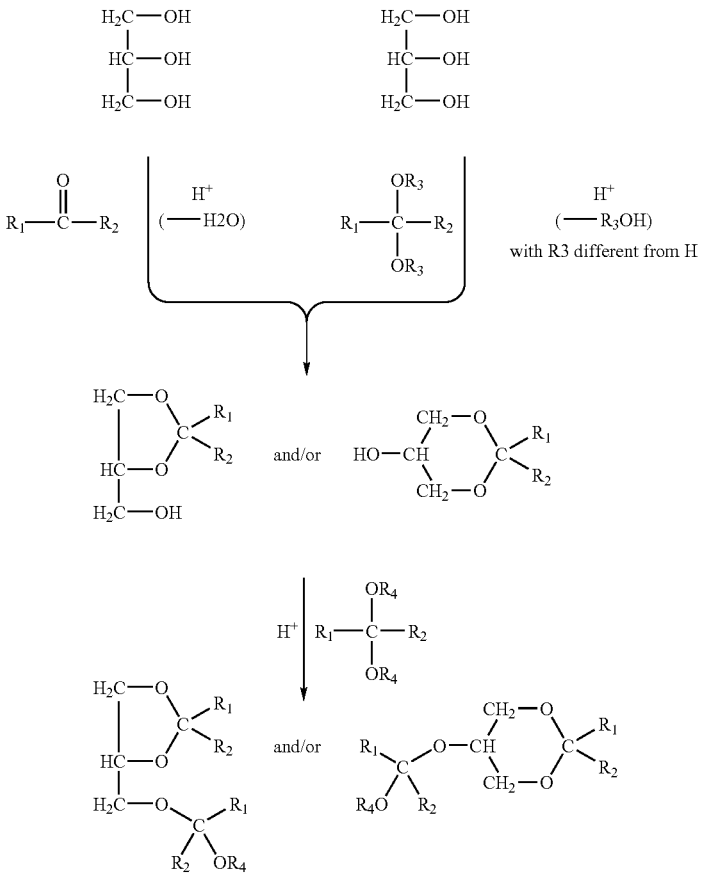

These reactions that are applied to glycerol are described in, for example, the following publications:

| | | |
|---|---|---|
| - | Piantadosi et coll. | J. of Am. Chem. Soc. (1958), 6613 |
| - | Gelas et coll. | Bull Soc Chim Fr, (1969), No. 4, 1300 |
| | | Bull Soc Chim Fr, (1970), No. 6, 2341 |
| | | Bull Soc Chim Fr, (1970), No. 6, 2349 |
| - | Gelas et coll. | CR. Ac. Sc. Paris (1970), 218. |

The products that are used in the invention can consist of one or more compounds that correspond to general formulas (1) and (2).

The introduction of these products into the compositions of diesel engine fuels results in diesel engine fuels that make possible a reduction in pollutant emissions, in particular emissions of particles relative to the fuel that does not contain the products in question.

In the diesel fuel compositions according to the invention, the diesel fuel that is being considered can be of petroleum origin or a mixture of alkyl esters derived from vegetable oils.

According to the invention, the diesel fuel compositions of the invention can contain glycerol acetals in varied proportions. The glycerol acetal carbonate or each of the glycerol acetal carbonates will be introduced into the diesel fuel at a concentration such that it is soluble in said diesel fuel. According to the cases, proportions of 1 to 40% by volume, most often 1 to 20% by volume, are used.

Finally, the diesel fuel compositions of the invention are generally free of metal compounds of group IIA of the periodic table.

The following examples illustrate the invention without limiting it.

EXAMPLES

In Examples 1 and 2, the synthesis of glycerol acetal carbonates is described. Example 3 describes tests for evaluating the performance levels of gas oil compositions that contain glycerol acetal carbonates that are prepared in Examples 1 and 2.

Example 1

920 g (10 mol) of glycerol, 790.3 g (10.96 mol) of n-butyraldehyde and 24 g of an Amberlyst 15® acid resin are introduced into a reactor. The medium is brought to 54° C. while being stirred for 7 hours, during which 120 g of n-butyraldehyde is introduced.

After returning to ambient temperature, the elimination of the catalyst is initiated by filtration, then excess n-butyraldehyde as well as reaction water are eliminated by evaporation under reduced pressure. 1165 g of a clear liquid that is soluble in gas oil and whose elementary analysis is as follows:

C=56.7% by mass

H=10.1% by mass

O=33.2% by mass and that corresponds for the most part to the following formula:

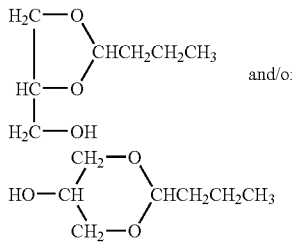

and/or is collected.

In a reactor that is equipped with a Dean & Stark separator, 400 g of this product, 970 g (8.2 mol) of diethyl carbonate, then 4 g of sodium hydride are introduced. The medium is brought to 80° C., then gradually to 140° C. while eliminating the ethanol of the reaction that is formed by means of the Dean & Stark separator. After 5 hours of reaction, and after the medium has returned to ambient temperature, the neutralization of the catalyst is initiated with, for example, a sufficient amount of hydrochloric acid that is diluted in alcohol, then after filtration, the solvents and the excess reagents are evaporated under reduced pressure. 532 g of a clear liquid that is soluble in gas oil and whose elementary analysis is as follows:

C=55.35% by mass

H=8.25% by mass

O=36.4% by mass and that corresponds for the most part to the following formula:

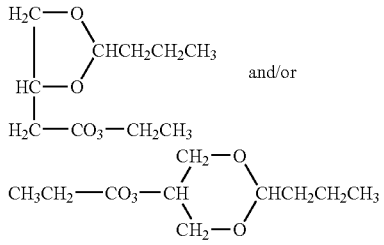

and/or is obtained.

The complete operation that is illustrated by this example is repeated so as to use 1 liter of product.

Example 2

Example 1 is reproduced by replacing n-butyraldehyde by an equimolar amount of acetone. The product of the reaction corresponds, for the most part, to the following formula:

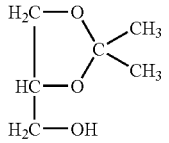

In a reactor that is equipped with a Dean & Stark separator, 132 g of this product, 590 g (5 mol) of diethyl carbonate, then 1 g of sodium hydride are introduced. The medium is brought to 80° C. then gradually to 140° C. while eliminating the reaction ethanol that is formed by means of a Dean & Stark separator. After 5 hours of reaction and after the medium has returned to ambient temperature, the neutralization of the catalyst is initiated with, for example, a sufficient amount of hydrochloric acid that is diluted in alcohol, then after filtration, the solvents and the excess reagents are evaporated under reduced pressure. 190 g of a clear liquid that is soluble in gas oil and whose elementary analysis is as follows:

C=52.4% by mass

H=7.8% by mass

O=39.8% by mass and that corresponds for the most part to the following formula:

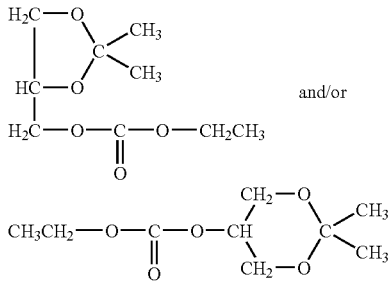

and/or is obtained.

The complete operation that is illustrated by this example is repeated so as to use 1 liter of product.

Example 3

Tests are carried out whose objective is to evaluate the performances of gas oil compositions that contain glycerol acetals that are prepared in the preceding examples.

The particle emissions that are measured with these fuels will be compared to those that are obtained with gas oil alone.

The tests were carried out starting from a gas oil that is representative of Euro 2000 formulations:

Density on the order of 0.832 at 15° C.;

Sulfur content on the order of 300 ppm;

Cetane number on the order of 53;

Distillation interval of 170/366° C.

The tests were conducted on a diesel vehicle equipped with a direct injection engine.

These tests were carried out on the cycle imposed by European Directive 70/220/CE, modified by the directive 98/69/EC (cycle called MVEG-11 is Euro 2000). This cycle consists of an urban phase (ECE cycle with a length of 4.052 km) and an extra-urban phase (EUDC cycle with a length of 6.955 km). The test results, expressed by gram of particles per kilometer, are presented on each of the phases of the cycle and on the complete cycle.

The results that are obtained are summarized in Table 1 below. They are expressed by gram of particles emitted per kilometer (g/km).

TABLE 1

| | Emission of Particles (g/km) | | |
|---|---|---|---|
| Evaluated Fuel | ECE Cycle | EUDC Cycle | MVEG Cycle |
| Gas Oil Alone | 0.0635 | 0.0517 | 0.0560 |
| Gas Oil: 95% Volume + Product of Example 1: 5% Volume | 0.0449 | 0.0374 | 0.0420 |
| Gas Oil: 95% Volume + Product of Example 2: 5% Volume | 0.0556 | 0.0455 | 0.0492 |

The reductions in the emissions of particles with the fuels according to the invention vary from 12% to 29% over all of the conditions tested in this example.

The invention claimed is:

1. A diesel fuel composition, comprising a major proportion of at least one diesel fuel and at least one glycerol acetal carbonate of the formulae:

(1)

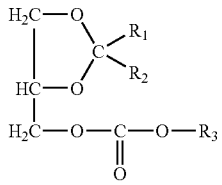

and/or

-continued (2)

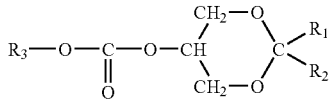

in which:

R1 and R2 are each a hydrogen atom, a hydrocarbon radical with 1 to 20 carbon atoms that is aliphatic, cycloaliphatic or aromatic, or an alkyl-ether chain, whereby R1 and R2 together can form an oxygenated heterocyclic radical;

R3 is a radical that is defined as R1 or R2, except for the hydrogen atom, or a radical of general formula:

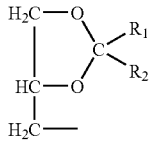

and/or

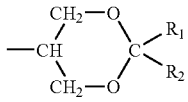

where R1 and R2 are defined as above, said composition being suitable for use as in diesel fuel.

2. The diesel fuel composition according to claim 1, wherein R1 and R2 are each a hydrogen, methyl, ethyl or propyl, and R3 is a methyl or ethyl.

3. The diesel fuel composition according to claim 1, wherein hydrogen the sum of the number of carbon atoms of R1, R2 and R3 is at least 2.

4. The diesel fuel composition according to claim 1, comprising a diesel fuel and a proportion of 1 to 40% by volume of at least one glycerol acetal carbonate.

5. The diesel fuel composition according to claim 4, having a proportion of glycerol acetal carbonate of 1 to 20% by volume.

6. The diesel fuel composition according to claim 1, comprising a diesel fuel of petroleum origin.

7. The diesel fuel composition according to claim 1, comprising a mixture of alkyl esters that are derived from vegetable oils.

8. The diesel fuel composition according to claim 1, comprising a diesel fuel and a proportion of 1 to 20% by volume of at least one glycerol acetal carbonate.

* * * * *

UNITED STATES PATENT AND TRADEMARK OFFICE

CERTIFICATE OF CORRECTION

PATENT NO. : 7,097,674 B2
APPLICATION NO. : 10/322473
DATED : August 29, 2006
INVENTOR(S) : Bruno Delfort It is certified that error appears in the above-identified patent and that said Letters Patent is hereby corrected as shown below:

Column 8, line 9, reads "R1 and R2" should read -- $R_1$ and $R_2$ --
Column 8, line 12, reads "R1 and R2" should read --$R_1$ and $R_2$ --
Column 8, line 14, reads "R3" should read -- $R_3$ --
Column 8, line 14, reads "R1 or R2," should read -- $R_1$ or $R_2$, --
Column 8, line 23, reads "R1 and R2" should read --$R_1$ and $R_2$ --
Column 8, line 26, reads "R1 and R2" should read --$R_1$ and $R_2$ --
Column 8, line 26, reads "are each a hydrogen," should read -- are each hydrogen, --
Column 8, line 27, reads "R3 is a methyl" should read -- $R_3$ is methyl --
Column 8, line 29, reads "wherein hydrogen" should read --wherein --
Column 8, line 30, reads "R1, R2 and R3" should read --$R_1$, $R_2$ and $R_3$--

Signed and Sealed this

Seventeenth Day of July, 2007

JON W. DUDAS
*Director of the United States Patent and Trademark Office*